US006089935A

United States Patent [19]

Fleming, III

[11] Patent Number: 6,089,935

[45] Date of Patent: Jul. 18, 2000

[54] WATER SKI ATTACHMENT

[76] Inventor: G. Thomas Fleming, III, 5111 Alta Canyada Rd., La Canada, Calif. 91011

[21] Appl. No.: 09/135,511

[22] Filed: Feb. 6, 1998

[51] Int. Cl.[7] ..... B63B 35/81

[52] U.S. Cl. ..... 441/79

[58] Field of Search ..... 441/68, 79, 71; 114/166, 288; 440/68, 66, 71

[56] References Cited

U.S. PATENT DOCUMENTS

| | | | |
|---|---|---|---|
| D. 343,437 | 1/1994 | De Paoli . | |
| 2,704,043 | 3/1955 | Drier . | |
| 2,940,091 | 6/1960 | Fifer . | |
| 3,020,568 | 2/1962 | Tierney . | |
| 3,025,539 | 3/1962 | Kincaid . | |
| 3,052,899 | 9/1962 | Antoine . | |
| 3,077,616 | 2/1963 | Billingham . | |
| 3,089,157 | 5/1963 | May . | |
| 3,103,673 | 9/1963 | Martin, Jr. . | |
| 3,144,849 | 8/1964 | Maser | 441/68 |
| 3,229,312 | 1/1966 | Smith . | |
| 3,255,472 | 6/1966 | Thorne . | |
| 3,635,186 | 1/1972 | German | 440/71 |
| 3,685,068 | 8/1972 | Reed . | |

*Primary Examiner*—Sherman Basinger
*Attorney, Agent, or Firm*—Pretty, Schroeder & Poplawski

[57] ABSTRACT

A water ski has an upper side, an under side, a front end and a rear end, with an arched fin carried on the ski under side at the ski rear end. The arched fin has opposed edges adjacent the edges of the ski under side, with the opposed edges joined together adjacent the ski rear end to form an opening for water flow therethrough, and with the opposed edges tapering forward and upward from the opening to the ski under side, and terminating forward of the ski rear end. The arched fin and ski form a continuous channel for water flow along the bottom of the ski toward the rear end, preferably with the cross-section area of the forward end of the channel is greater than the cross-section area of the rear end of the channel.

10 Claims, 3 Drawing Sheets

WATER SKI ATTACHMENT

BACKGROUND OF THE INVENTION

The present invention relates to a new and improved fin for a water ski which accomplishes three purposes: first, creating a "venturi" effect propels the ski as it performs certain turns and other maneuvers at a relatively greater rate of speed than a ski with a conventional fin or skeg; second, the application of a gradually tapering leading edge provides more positive edge control and stability for the ski in any attitude, particularly during turns; and third, the use of a tapering edge, culminating in an arch extending from one rail to the other at the rear of the ski that provides continuous contact with the surface of the water, and therefore greater control of the ski, during turning maneuvers, at angles of bank of up to 90° relative to the surface of the water.

The commonly used water ski has a knife-like fin or skeg which extends approximately 4½ inches below the surface of the ski. However, this type of fin loses contact with the water during turning maneuvers at angles of bank over approximately 45°, and at lesser angles of bank in rough water. In addition, skis with conventional skegs accelerate through the water only as a result of pressure applied through the skier's feet and legs and, ultimately, while there is constant tension on the skier's tow rope. Thus, during turns and other maneuvers which cause a decrease or cessation of tension on the tow rope, a water ski with a conventional skeg experiences a corresponding decrease or cessation of its speed through the water.

In the present invention a hollow, tapering "tunnel" is provided for attachment along the bottom rear portion of a water ski, with the generally U-shaped area in which the water enters the device being greater than the area of the generally O-shaped area where the water exits. Additionally, the leading edges or "rails" of the device taper gradually from the arch at the rear of the ski edges or "rails" of the device taper gradually from the arch at the rear of the ski and along the two outside edges of the ski until they terminate, flush with the ski bottom, as they approach the mid-point of the ski. A continuous flow of water along the bottom of the ski is directed along these leading edges or "rails" and into the aperture of the fin. As water passes into the increasingly narrow interior or "tunnel" portion of the fin, it necessarily will travel increasingly faster until it exits at the rearward aperture of the fin. In the process, the fin will provide a high degree of lateral and vertical stability, as well as a "venturi" effect which will cause the ski, as it performs turns and other maneuvers, to travel at a relatively greater rate of speed than a ski with a conventional skeg.

The present invention differs from other patented designs, including those in U.S. Pat. Nos. 2,704,043; 2,940,091; 3,020,568; 3,025,539; 3,052,899, 3,077,616; 3,229,312 and 3,255,472, the purpose of which is solely to re-direct water upward and in the process causes substantial drag without improving the performance of the ski. Instead, in the present invention, the flow of water continues uninterrupted along the longitudinal axis of the ski, thus creating no appreciable drag; the flow of water is directed by the edges or "rails" into the forward aperture of the fin; and the flow of water increases in speed from the point at which it enters the aperture of the fin tunnel until it exits the fin tunnel. Other designs which re-direct water flow upward provide merely aesthetic benefits, cause substantial drag, and provide none of the improved performance and handling properties of the present invention.

The present invention also differs from other patented designs, including those in U.S. Pat. Nos. 343,437; 3,089,157; and 3,103,673, because it incorporates venturi technology with a twin fin or arched fin design, with edges which taper forward gradually from the arch of the fin tunnel, following the outside edges of the ski until they gradually terminate, flush with the ski bottom, near the mid-point of the ski. The effect of these tapering edges, in conjunction with the fin tunnel, is to both provide increased edge control during turns, and also to direct water flow into the fin tunnel, thereby increasing the venturi effect. Other facially similar designs provide neither of these properties.

Accordingly, it is an object of the present invention to provide a new and improved water ski with arched fin which will overcome the shortcomings of the prior art water ski constructions.

Other objects, advantages, features and results will more fully appear in the course of the following description.

SUMMARY OF THE INVENTION

The water ski of the invention has an upper side, an under side, a front end and a rear end, with an arched fin carried on the ski under side at the ski rear end. The arched fin has opposed edges adjacent the edges of the ski underside, with the opposed edges joined together adjacent the ski rear end to form an opening for water flow therethrough, and has the opposed edges tapering forward and upward from the opening to the ski under side, and terminating forward of the ski rear end.

The arched fin and ski form a continuous channel for water flow along the bottom of the ski toward the rear end, with the cross-section area of the forward end of the channel greater than the cross-section area of the rear end of the channel, and the ratio of the cross-section area of the forward end of the channel to the cross-section area of the rear end of the channel is up to 2 to 1. Further, desirably the forward end of the channel is substantially U-shaped and the rear end of the channel is substantially circular, with the opposing edges of the ski converging toward each other at the rear portion of the ski, and the opposing edges of the arched fin conforming to the edges of the ski.

DESCRIPTION OF THE PREFERRED EMBODIMENTS

Figure 1:
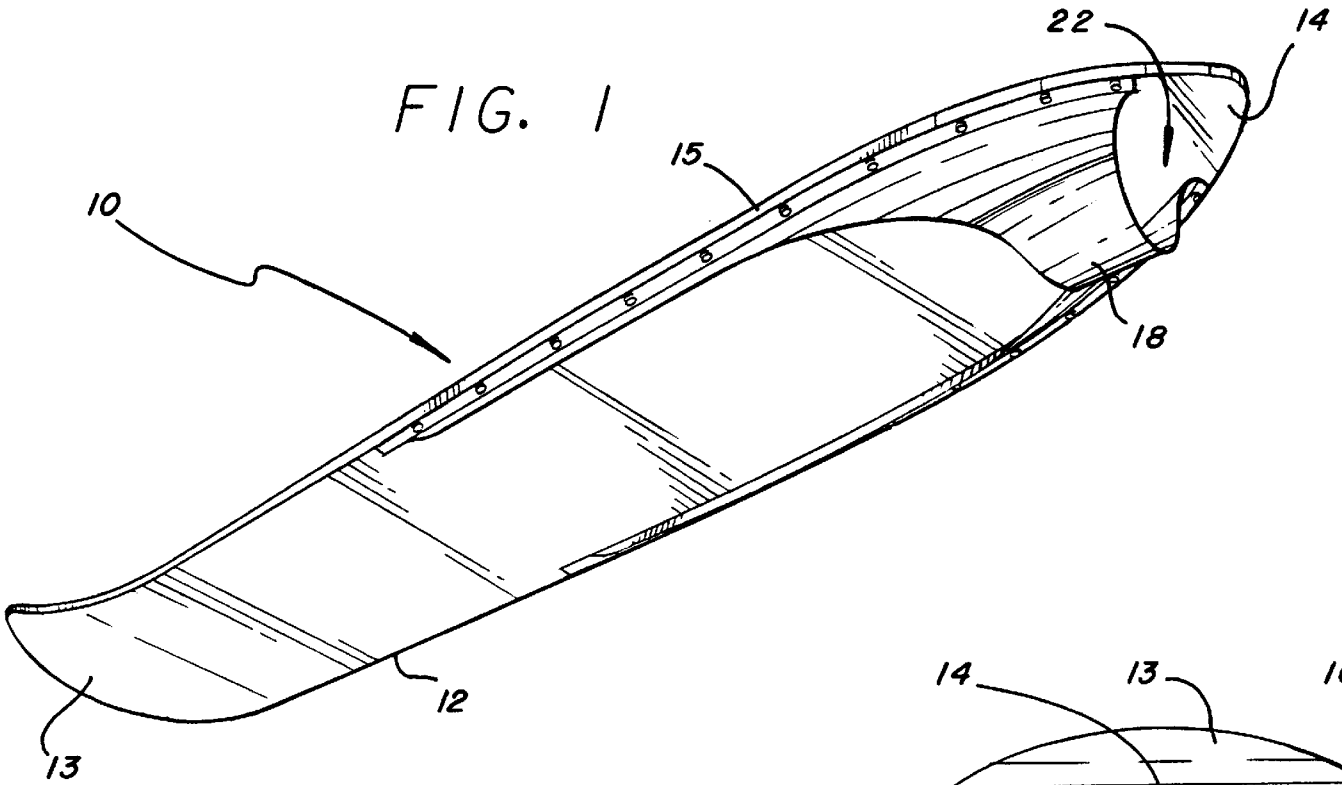
FIG. 1 is a perspective view of a water ski incorporating the presently preferred embodiment of the invention.
Figure 2:
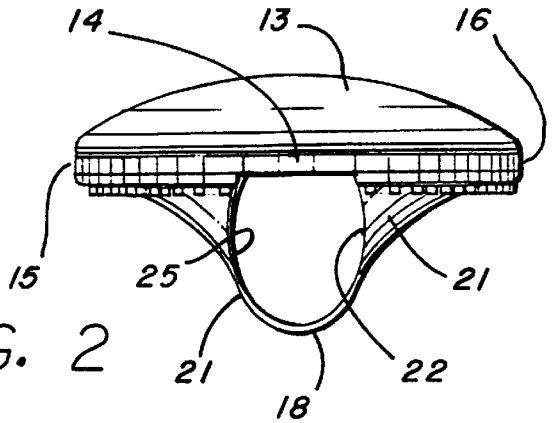
FIG. 2 is a rear end view of the ski of FIG. 1.

A water ski 10 is shown in the drawings with an underside 11, an upper side 12, a front end 13, and a rear end 14. The ski also has outer edges 15, 16 extending between the front and rear ends. Typically the front end 13 is curved upward, and the rear end 14 tapers to a rounded terminus. This ski may be conventional in configuration and construction.

Figure 3:
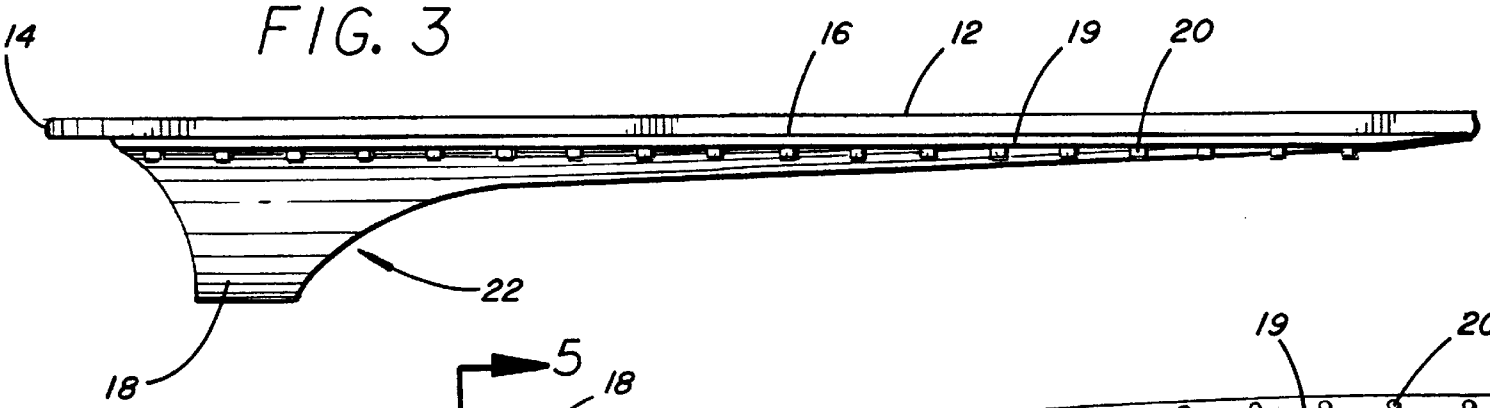
FIG. 3 is a side view of the rear portion of the ski of FIG. 1.
Figure 4:
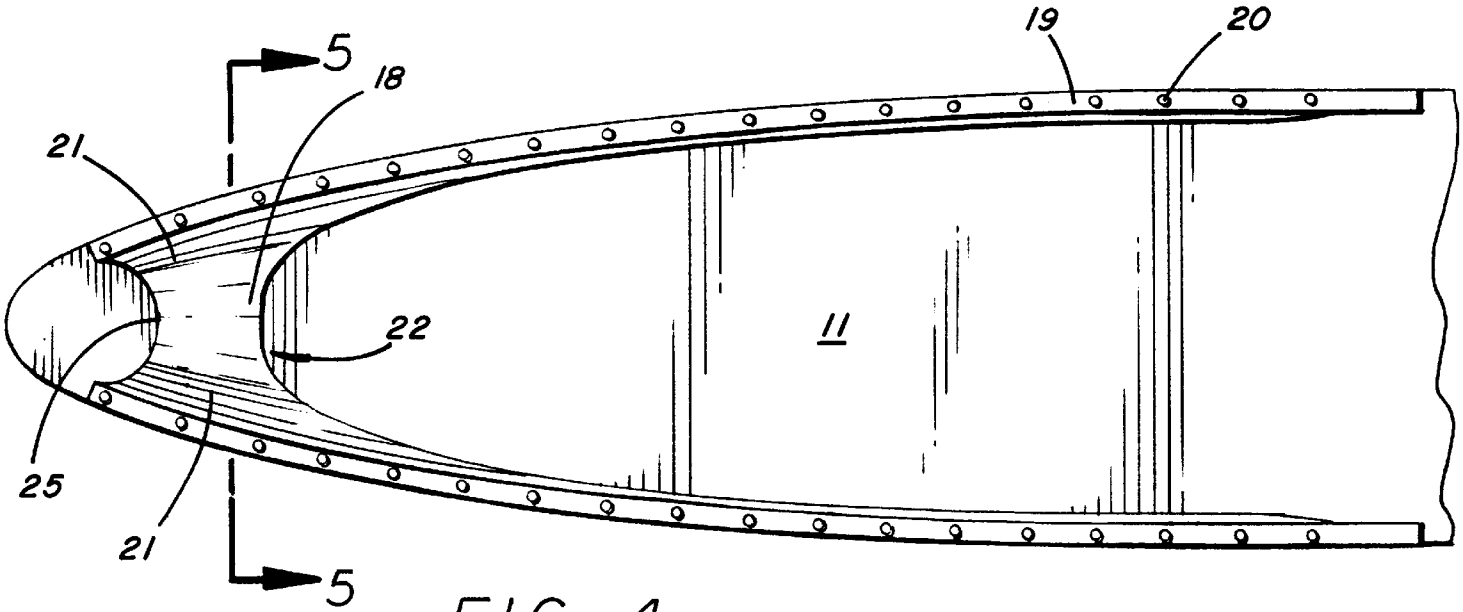
FIG. 4 is a bottom view of the rear portion of the ski of FIG. 1.

An arched fin 18 is carried on the underside of the ski at the rear end. Preferably the arched fin is made as a single piece and in the embodiment shown in FIGS. 1–5 is attached to the under side of the ski with a mounting strip 19 and fasteners 20, typically rivets or screws. The arched fin has opposed edges 21 adjacent the edges of the ski under side, with the opposed edges joined together adjacent the ski rear end to form an opening 22 for water flow through the arched fin. The opposed edges 21 taper forward and upward from the opening 22 to the ski under side 11, as best seen in FIG. 3, and terminate forward of the ski rear end. The arched fin and the ski together form a continuous channel for water flow along the bottom of the ski toward its rear end. The water flow channel formed by the opening 22 has a forward end 24 and a rear end 25. Desirably, the cross-section area of the forward end is greater than the crosssection area of the rear end. Preferably, the ratio of the cross-section area of the forward end of the channel to the cross-section area of the rear end of the channel defined by the forward end and rear end, respectively, is up to 2-1. Also preferably the forward end 24 is substantially U-shaped and the rear end 25 is substantially circular.

Desirably, the opposing edges of the ski 15, 16 converge toward each other at the rear portion of the ski, and the opposing edges 21 of the arched fin conform to the edges of the ski.

The water flow channel formed by the opening 22 is aligned with a longitudinal axis of the ski and permits the flow of water through the fin as the ski is towed along the surface of the water. Desirably, the opposed edges 21 of the arched fin follow the outer edges 15, 16 of the ski, and taper gradually downward from the front end of the arched fin in a rear ward direction and meet to form the opening 22, which serves as the aperture for the tunnel formed by the arched fin. These gradually tapering opposed edges both direct water into the opening of the arched fin and provide excellent edge control properties for the ski during turns and other maneuvers.

Preferably, the arched fin is formed as a unitary body and may be fabricated from a variety of materials, including die cast aluminum, fiberglass, sheet metal, graphite, and other materials which will provide a substantially rigid finished product.

Figure 5:
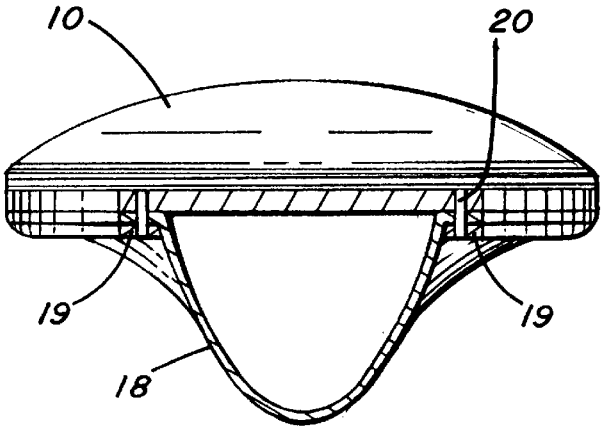
FIG. 5 is a sectional view taken along the line 5—5 of FIG. 4.

The presently preferred method of attaching the arched fin to the ski is shown in FIG. 5. Preferably, the screws or rivets used to attach the fin to the ski would be flush with the surface, to reduce drag.

Figure 6:
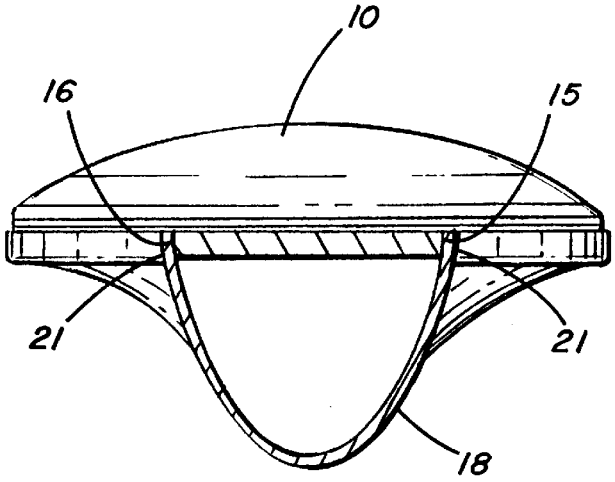
FIGS. 6, 7 and 8 are views similar to that of FIG. 5 showing alternative embodiments of construction.
Figure 7:
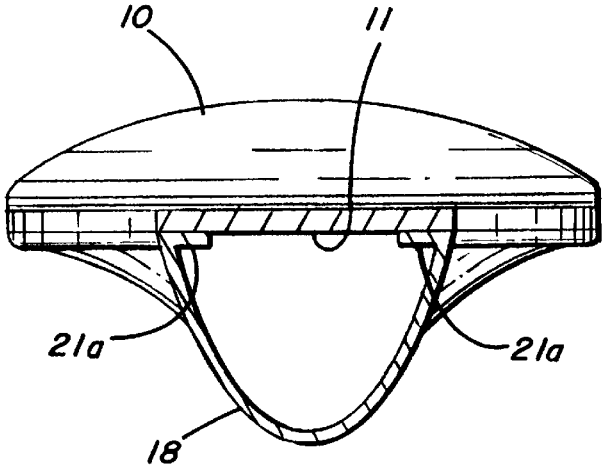
Figure 8:
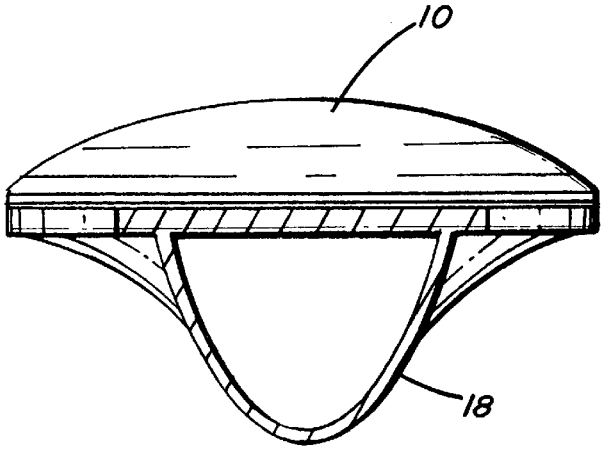

Other arrangements for attaching the arched fin to the ski are shown in FIGS. 6, 7 and 8. In the embodiment of FIG. 6, the edges 21 of the arched fin are positioned at the edges 15, 16 of the ski and are attached by an adhesive or a fastener.

In the embodiment of FIG. 7, the edges 21 of the arched fin have inwardly turned flanges 21*a*, which rest against the under side 11 of the ski and are attached by suitable fasteners.

In the embodiment of FIG. 8, the arched fin is formed integral with the ski 10 during the manufacture of the ski.

Thus, it is seen that the unique construction of the arched fin with the water ski meets the objects of the present invention.

I claim:

1. A water ski comprising:

an upper side, an under side, a front end and a rear end, with an arched fin carried on said ski under side at said ski rear end;

said arched fin having opposed edges adjacent the edges of said ski under side, with said opposed edges joined together adjacent said ski rear end to form an opening for water flow therethrough; and with said opposed edges tapering forward and upward from said opening to said ski under side, and terminating forward of said ski rear end, the opposing edges of said ski converge toward each other at the rear portion of said ski, and the opposing edges of said arched fin conform to said edges of said ski.

2. A water ski as defined in claim 1 wherein said arched fin is formed integral with said ski.

3. A water ski as defined in claim 1 wherein said arched fin is formed separately and is attached to said ski.

4. A water ski as defined in claim 1 wherein said arched fin and ski form a continuous channel for water flow along the bottom of said ski toward said rear end.

5. A water ski as defined in claim 4 wherein the cross-section area of the forward end of said channel is greater than the cross-section area of the rear end of said channel.

6. A water ski as defined in claim 4 wherein the ratio of the cross-section area of the forward end of said channel to the cross-section area of the rear end of said channel is up to 2 to 1.

7. A water ski as defined in claim 4 wherein the forward end of said channel is substantially U-shaped and the rear end of said channel is substantially circular.

8. A water ski comprising:

an upper side, an under side, a front end and a rear end, with an arched fin carried on said ski under side at said ski rear end;

said arched fin having opposed edges adjacent the edges of said ski under side, with said opposed edges joined together adjacent said ski rear end to form an opening for water flow therethrough;

with said opposed edges tapering forward and upward from said opening to said ski under side, and terminating forward of said ski rear end, and with the arched fin and ski forming a continuous channel for water flow along the bottom of said ski toward said rear end;

with the cross-section area of the forward end of said channel greater than the cross-section area of the rear end of said channel, and with the forward end of said channel substantially U-shaped and the rear end of said channel substantially circular; and with the opposing edges of said ski converging toward each other at the rear portion of said ski, and the opposing edges of said arched fin conforming to said edges of said ski.

9. An arched fin for a water ski comprising:

an upper side, an under side, a front end and a rear end;

said arched fin having opposed edges for positioning adjacent the edges of said ski under side to form an opening for water flow therethrough; and with said opposed edges tapering forward and upward from said opening for terminating forward of said ski rear end so that the arched fin and ski may form a continuous channel for water flow along the bottom of said ski toward said rear end;

with the forward end of said arched fin substantially U-shaped and the rear end thereof substantially circular.

10. A water ski as defined in claim 9 wherein the opposing edges of said arched fin converge toward each other at the rear portion thereof.

* * * * *